US008686810B2

(12) United States Patent
Park et al.

(10) Patent No.: US 8,686,810 B2
(45) **Date of Patent: *Apr. 1, 2014**

(54) FREQUENCY TUNEABLE FILTER USING A SLIDING SYSTEM

(75) Inventors: Kwang-Sun Park, Suwon-si (KR); Suk-Woo Lee, Bucheon-si (KR); Jae-Ok Seo, Bucheon-si (KR); Dong-Wan Chun, Incheon-si (KR)

(73) Assignee: Ace Technologies Corp., Incheon-Si (KR)

( * ) Notice: Subject to any disclaimer, the term of this patent is extended or adjusted under 35 U.S.C. 154(b) by 675 days.

This patent is subject to a terminal disclaimer.

(21) Appl. No.: 12/918,368

(22) PCT Filed: Feb. 13, 2009

(86) PCT No.: PCT/KR2009/000726

§ 371 (c)(1),
(2), (4) Date: Oct. 21, 2010

(87) PCT Pub. No.: WO2009/104882

PCT Pub. Date: Aug. 27, 2009

(65) Prior Publication Data

US 2011/0032054 A1 Feb. 10, 2011

(30) Foreign Application Priority Data

Feb. 19, 2008 (KR) ..... 10-2008-0014810

(51) Int. Cl.
*H01P 1/205* (2006.01)
*H01P 7/04* (2006.01)

(52) U.S. Cl.
USPC ..... 333/203; 333/235

(58) Field of Classification Search
USPC ..... 333/202–203, 208–209, 212, 227, 333/231–233, 235
See application file for complete search history.

(56) References Cited

U.S. PATENT DOCUMENTS

| | | | | |
|---|---|---|---|---|
| 6,778,034 | B2 * | 8/2004 | Nir et al. | 333/12 |
| 7,834,721 | B2 * | 11/2010 | Juri | 333/202 |
| 2004/0044144 | A1 * | 3/2004 | Yoshida et al. | 525/417 |
| 2006/0139128 | A1 | 6/2006 | Ala-Kojola | |
| 2007/0052495 | A1 | 3/2007 | Wada | |

FOREIGN PATENT DOCUMENTS

| | | |
|---|---|---|
| KR | 20050020928 X | 3/2005 |
| KR | 20060043849 A | 5/2006 |

OTHER PUBLICATIONS

International Search report corresponding to PCT/KR2009/000726 issued Oct. 6, 2009.

* cited by examiner

*Primary Examiner* — Benny Lee
*Assistant Examiner* — Rakesh Patel
(74) *Attorney, Agent, or Firm* — Duane Morris LLP

(57) ABSTRACT

A frequency-tunable filter using a sliding system is disclosed. The frequency-tunable filter includes: a housing, in which a multiple number of cavities are defined by partitions; a sub-cover, which is coupled to an upper portion of the housing and in which a guide groove is formed; at least one sliding member installed in the guide groove; a main cover coupled to an upper portion of the sub-cover; a resonator held in the cavity; and at least one tuning element coupled to a lower portion of the sliding member to be inserted inside the housing, where tuning is achieved by a sliding movement of the sliding member, and at least one first guide member is coupled to at least one side surface of the sliding member such that the first guide member guides a sliding movement by way of contact with the side surface of the guide groove.

9 Claims, 6 Drawing Sheets

FREQUENCY TUNEABLE FILTER USING A SLIDING SYSTEM

CROSS-REFERENCE TO RELATED APPLICATIONS

This application is the National Phase of PCT/KR2009/00726 filed on Feb. 13, 2009, which claims priority under 35 U.S.C. 119(a) to Patent Application No. 10-2008-0014810 filed in the Republic of Korea on Feb. 19, 2008, all of which are hereby expressly incorporated by reference into the present application.

BACKGROUND

1. Technical Field

The present invention relates to a filter, more particularly to a tunable filter that can vary its filter properties, such as the center frequency and bandwidth of the filter, by utilizing a sliding system.

2. Description of the Related Art

A filter is a device for passing signals of only a certain frequency band from among the inputted frequency signals, and is implemented in various ways. The band-pass frequency of an RF filter may be determined by the inductance and capacitance components of the filter, and the operation of adjusting the band-pass frequency of a filter is referred to as tuning.

In a communication system, such as a mobile communication system, certain frequency bands may be allotted to certain businesses, which may divide the allotted frequency bands into several channels for use. In the related art, communication businesses generally manufacture and use a separate filter that is for suitable for each frequency band.

In recent times, however, rapid changes in the communication environment have created a need for a filter to have variable properties, such as for the center frequency and bandwidth, for example, unlike the earlier environment for mounting filters. For varying the properties in this manner, a tunable filter may be used.

FIG. 1 illustrates the structure of a tunable filter according to the related art.

Referring to FIG. 1, a filter according to the related art may include a housing 100, an input connector 102, an output connector 104, a cover 106, and multiple numbers of cavities 108 and resonators 110.

An RF filter is a device for passing signals of only a certain frequency band from among the inputted frequency signals, and is implemented in various ways.

A number of walls may be formed within the filter, with the walls defining cavities 108 in which to hold the resonators, respectively. The cover 106 may include tuning bolts 112, as well as coupling holes for coupling the housing 100 with the cover 106.

The tuning bolts 112 may be coupled to the cover 106 and may penetrate inside the housing. The tuning bolts 112 may be arranged on the cover 106 in corresponding positions in relation to the resonators or in relation to particular positions inside the cavities.

RF signals may be inputted by way of the input connector 102 and outputted by way of the output connector 104, where the RF signals may progress through the coupling windows formed in the cavities, respectively. Each of the cavities 108 and resonators 110 may generate a resonance effect of the RF signals, and this resonance effect may filter the RF signals.

In a filter according to the related art, such as that shown in FIG. 1, the tuning of frequency and bandwidth may be achieved using the tuning bolts.

FIG. 2 is a cross-sectional view of a cavity in a tunable filter according to the related art.

Referring to FIG. 2, a tuning bolt 112 may penetrate through the cover 106 to be located above a resonator. The tuning bolt 112 may be made of a metallic material and may be secured to the cover by way of screw-coupling.

Hence, the tuning bolt 112 can be rotated to adjust its distance to the resonator, and by thus varying the distance between the resonator 110 and the tuning bolt 112, tuning may be achieved. The tuning bolt 112 can be rotated manually, or a separate machine for rotating the tuning bolt 112 can be employed. If the tuning achieved at an appropriate position, the tuning bolt may be secured using a nut.

FIG. 3 is a diagram illustrating the principle on which tuning is achieved by rotating a tuning bolt.

Referring to FIG. 3, capacitance (C) is formed between the tuning bolt and the resonator. Capacitance is a physical property that varies depending on the permittivity between two metals, the cross-sectional areas, and the distance. Here, the distance corresponds to the distance between the tuning bolt and the resonator.

Thus, as the distance between the tuning bolt and the resonator is changed due to the rotation of the tuning bolt, the capacitance can also be changed. Capacitance is one of the parameters that determines the frequency of a filter, and therefore the center frequency of a filter can be changed by altering the capacitance.

Although this filter according to the related art is structured to enable tuning by utilizing tuning bolts, it is considerably difficult for a user to tune the filter's properties using tuning bolts. In practice, tuning a filter using tuning bolts was usually performed only by the filter manufacturer to fine-tune the properties after the manufacture of the filter, as it was difficult for the user to perform the tuning.

SUMMARY

In order to resolve the above problem found in the related art, an aspect of the invention proposes a frequency-tunable filter that uses a sliding system to allow a user to easily perform a tuning maneuver.

Another aspect of the invention proposes a frequency-tunable filter using a sliding system with which the sliding operation employed for tuning can be performed in a more stable manner.

Another aspect of the invention proposes a frequency-tunable filter using a sliding system with which the height of the tuning element and the resonator can be adjusted.

Another aspect of the invention proposes a tunable filter using a sliding system that can provide a wider tuning range.

To achieve the objectives above, an aspect of the invention provides a frequency-tunable filter using a sliding system that includes: a housing, in which a multiple number of cavities are defined by partitions; a sub-cover, which is coupled to an upper portion of the housing and in which a guide groove is formed; at least one sliding member installed in the guide groove; a main cover coupled to an upper portion of the sub-cover; a resonator held in the cavity; and at least one tuning element coupled to a lower portion of the sliding member to be inserted inside the housing, where tuning is achieved by a sliding movement of the sliding member, and at least one first guide member is coupled to at least one side surface of the sliding member such that the first guide member guides a sliding movement by way of contact with the side surface of the guide groove.

The tunable filter can further include at least one second guide member, which may be coupled to an upper portion of the sliding member and which may guide a sliding movement by way of contact with a lower portion of the main cover.

The first guide member and the second guide member can be elastic bodies and can include a flat spring.

Preferably, an elongated hole may be formed in the guide groove of the sub-cover so as to allow the tuning element to be inserted in the housing and enable the tuning element to freely undergo a sliding movement.

A bolt hole for inserting a tuning bolt inside the housing may be formed in the sub-cover.

Preferably, the sliding member may be made from an amorphous thermoplastic polyetherimide material.

A threaded hole may be formed in the sliding member, an adjustment bolt may be inserted in the threaded hole that has its insertion depth adjusted by rotation, and the tuning element may be coupled to a lower portion of the adjustment bolt.

The material for the adjustment bolt can be substantially the same as that of the sliding member.

The tunable filter described above can further include a driving unit that provides a driving power for sliding the sliding member, where the sliding member can include a coupling hole for coupling with the driving unit.

Another aspect of the invention provides a frequency-tunable filter using a sliding system that includes: a housing, in which a multiple number of cavities are defined by partitions; a resonator held in the cavity; at least one sliding member installed over the resonator; and a tuning element coupled to a lower portion of the sliding member, where a threaded hole is formed in the sliding member, an adjustment bolt is inserted in the threaded hole that has its insertion depth adjusted by rotation, and the tuning element is coupled to a lower portion of the adjustment bolt.

An aspect of the invention enables the user to easily perform a tuning maneuver and allows the sliding movement to occur with greater stability.

Also, an aspect of the invention provides a wider tuning range, by making it possible to adjust the height of the tuning element in relation to the resonator.

Additional aspects and advantages of the present invention will be set forth in part in the description which follows, and in part will be obvious from the description, or may be learned by practice of the invention.

DETAILED DESCRIPTION

The frequency-tunable filter according to certain preferred embodiments of the invention will be described below in more detail with reference to the accompanying drawings.

Figure 1:
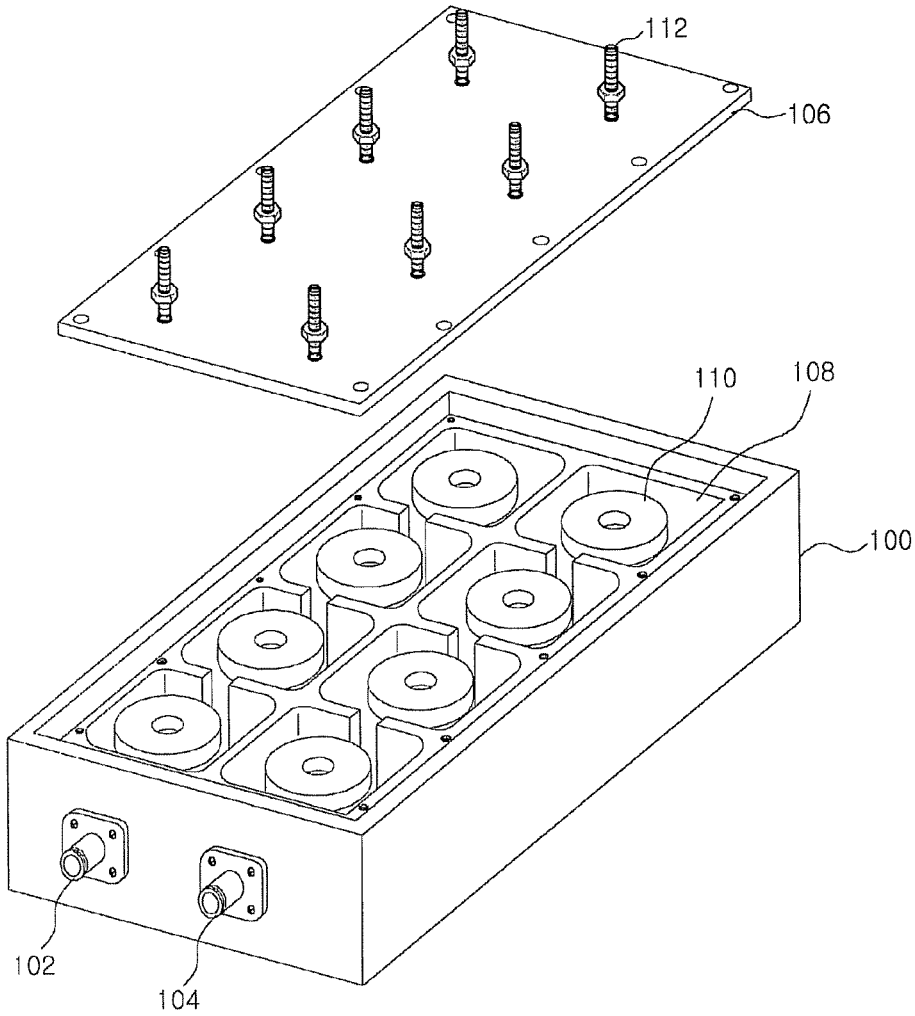
Fig. 1 (Prior Art)
FIG. 1 illustrates the structure of a tunable filter according to the related art.
Figure 2:
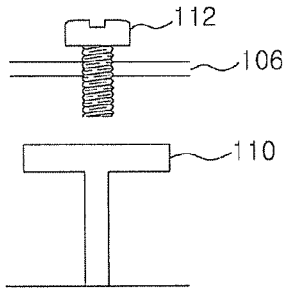
Fig. 2 (Prior Art)
FIG. 2 is a cross-sectional view of a cavity in a tunable filter according to the related art.
Figure 3:
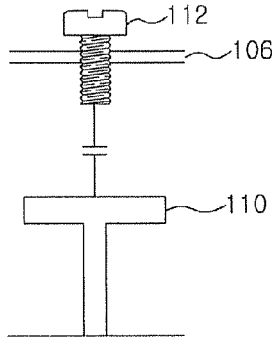
Fig. 3 (Prior Art)
FIG. 3 is a diagram illustrating the principle on which tuning is achieved by rotating a tuning bolt.
Figure 4:
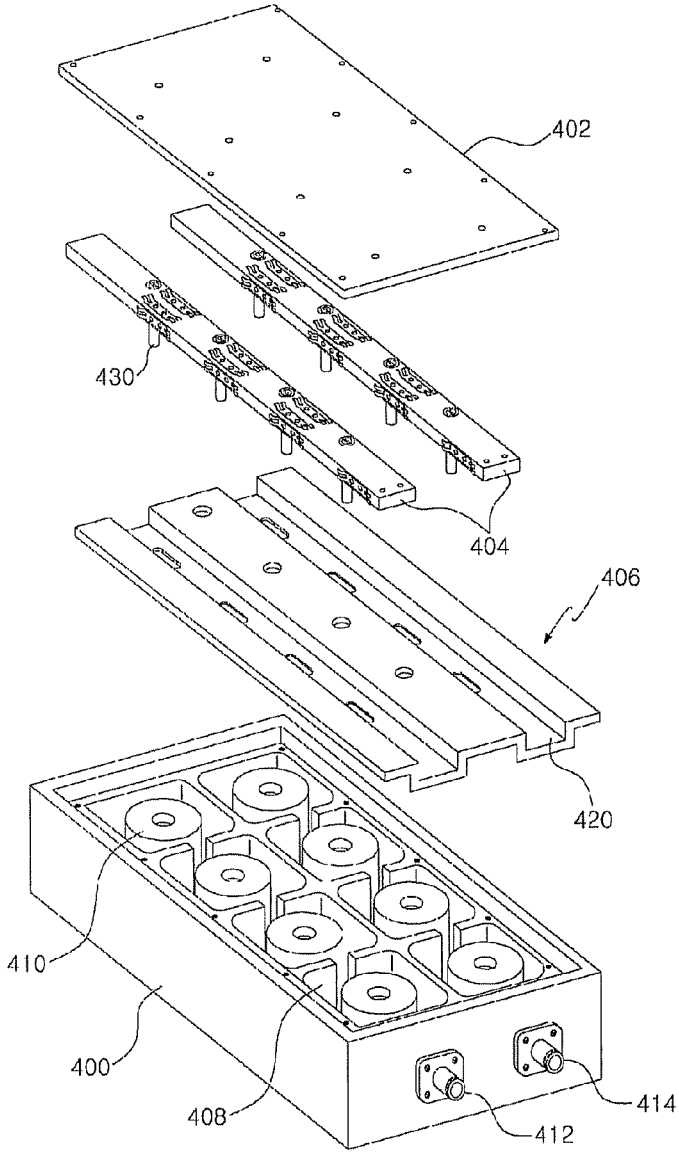
FIG. 4 is an exploded perspective view of a frequency-tunable filter using a sliding system according to an embodiment of the invention.

FIG. 4 is an exploded perspective view of a frequency-tunable filter using a sliding system according to an embodiment of the invention.

Referring to FIG. 4, a frequency-tunable filter according to an embodiment of the invention can include a housing 400, main cover 402, sliding members 404, sub-cover 406, several cavities 408, several resonators 410, an input connector 412, and an output connector 414.

The housing 400 may serve to protect the components such as resonators, etc., inside the filter and to shield electromagnetic waves. The housing 400 can be made by forming a base from an aluminum material and applying plating over the base. For RF equipment such as filters and waveguides, silver plating is generally used to minimize loss, due to its high electrical conductivity. In recent times, plating methods other than silver plating are also used, to improve properties such as corrosion resistance, for example, and a housing made using such plating methods can also be used.

The sub-cover 406 can be coupled to the housing at an upper portion of the housing, and can be coupled with the housing by bolts and fastening holes. Guide grooves 420 may be formed in the sub-cover 406, so that the sliding members 404 may undergo a sliding movement in a stable manner.

A number of partitions may be formed inside the filter, and these partitions, together with the housing 400 of the filter, may define the cavities 408 in which the resonators 410 are to be held. The number of cavities and resonators are related to the order of the filter, and FIG. 4 illustrates an example in which the order is 8, i.e. there are 8 resonators. The order of a filter is related to insertion loss and skirt characteristics. One faces a tradeoff, as a higher order of a filter results in improved skirt characteristics but poorer insertion loss, and the order of a filter may thus be set according to the insertion loss and skirt characteristics required. While FIG. 4 illustrates an example in which cylindrical resonators are used, various forms of resonators can be used, such as disc-type resonators, etc.

In portions of the partitions, coupling windows may be formed in correspondence with the direction of progression of the RF signals. An RF signal that is resonated by a cavity and a resonator may progress through the coupling window into the next cavity.

The main cover 402 can be coupled to an upper portion of the sub-cover 406 and can be fastened by bolt-coupling.

The sliding members 404 may be installed to be capable of sliding along a direction perpendicular to the direction in which the resonators stand, i.e. along a horizontal direction. The sliding members 404 may be installed in the guide grooves formed in the upper portion of the sub-cover. The sliding members 404 can be made to slide automatically using motors or manually by a user. The structure by which the sliding members 404 are installed will be described in more detail with reference to a separate drawing.

The number of sliding members 404 can correspond to the number of resonator lines formed in the filter. FIG. 4 illustrates a filter having two resonator lines, in each of which four resonators are distributed, and correspondingly, the number of sliding members 404 is two.

Tuning elements 430 may be coupled onto a lower portion of each sliding member. The tuning elements 430 may penetrate to the inside of the filter through holes formed in the sub-cover 406. The material for the tuning elements 430 can be implemented as a dielectric material or as a metallic material.

The tuning elements 430 may be coupled to a lower portion of the sliding member 404 in correspondence with the resonators 410 equipped in the filter, such that each resonator has a corresponding tuning element. In the example shown in FIG. 4, there are four resonators at a lower portion of each sliding members 404, and hence there are four tuning elements 430 coupled to the sliding members 404. The intervals between tuning elements may also correspond with the installation intervals between resonators.

The sliding members 404 having tuning elements coupled thereto may be used for the filter tuning by the user. The rotary type tuning method using tuning bolts may not only involve a complicated procedure but may also be very time-consuming because of the individual tuning required.

An embodiment of the invention makes it possible to perform the tuning collectively in a simple manner, as the tuning may be performed by way of sliding members 404 to which the tuning elements 430 are coupled.

According to the sliding of the sliding members 404, the positions of the tuning elements 430 coupled thereto may also be varied. The interaction between the tuning elements 430 and the resonators 410 form capacitance, and when the positions of the tuning elements 430 are changed, the capacitance may also be changed.

Capacitance is determined by the distance between two metal bodies and the permittivity between the two metal bodies, and varying the position of a tuning element that is made of a metallic material or a dielectric material alters the capacitance, so that consequently, it is possible to perform tuning for the filter's properties.

If there are a multiple number of sliding members, the sliding members can be made to slide independently or can be made to slide collectively by means of a single motor. In cases where the sliding is performed collectively, it is possible to collectively apply tuning for all resonators of the filter, and even in cases where the sliding members slide independently, the tuning efficiency is significantly greater compared to the existing tuning method of using tuning bolts.

While it is not illustrated in FIG. 4, tuning bolts can be inserted from the sub-cover 406 into the filter for tuning during manufacture, in which case the inserted tuning bolts may serve substantially the same purpose as in the conventional filter.

Figure 5:
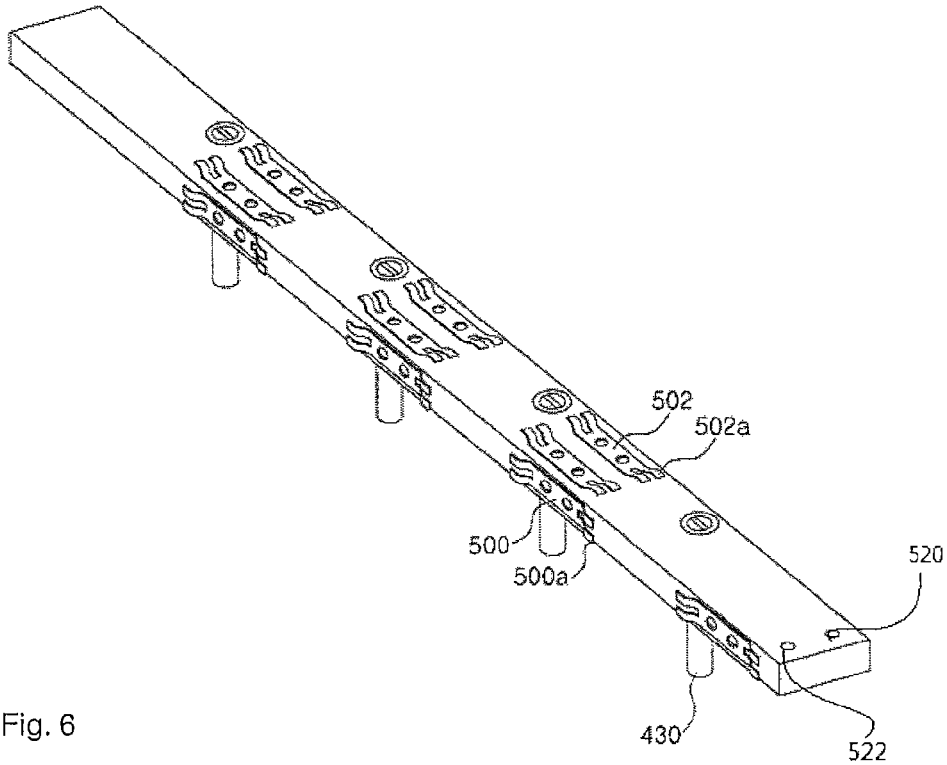
FIG. 5 is a perspective view of a sliding member according to an embodiment of the invention.
Figure 6:
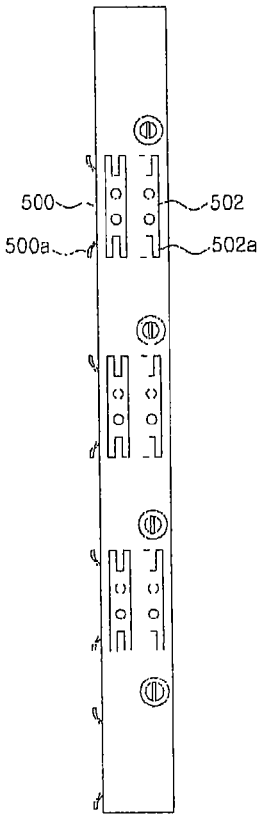
FIG. 6 is an upper plan view of a sliding member according to an embodiment of the invention.
Figure 7:
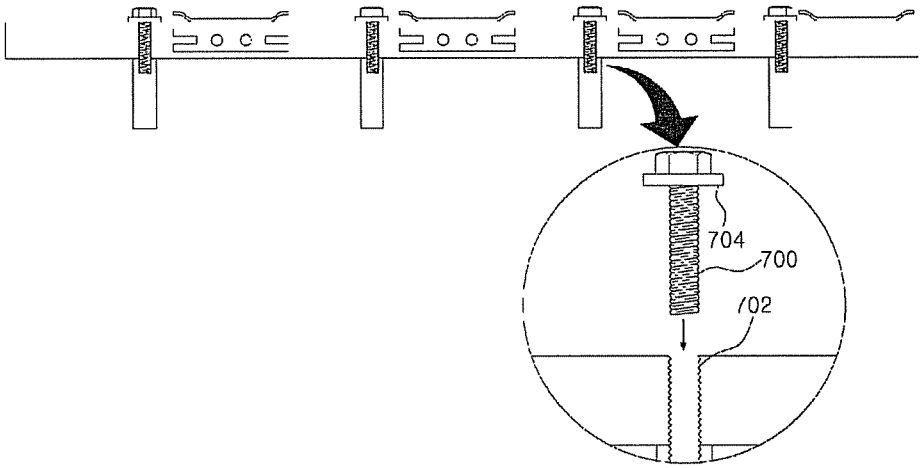
FIG. 7 is a cross-sectional view of a sliding member according to an embodiment of the invention.

FIG. 5 is a perspective view of a sliding member according to an embodiment of the invention, FIG. 6 is an upper plan view of a sliding member according to an embodiment of the invention, and FIG. 7 is a cross-sectional view of a sliding member according to an embodiment of the invention.

Referring to FIG. 5 through FIG. 7, tuning elements 430 may be coupled to the sliding members in particular intervals, and as already described above, the intervals between tuning elements 430 may correspond with the intervals between resonators.

In FIG. 7, an example is illustrated in which the tuning elements 430 are implemented in the shape of a cylindrical rod. However, the shape of the tuning elements 430 according to embodiments of the invention is not thus limited, and the skilled person will understand that the tuning elements 430 can be implemented in various shapes that allow for varying the capacitance.

Referring to FIG. 5 through FIG. 7, several first guide members 500 may be coupled to one side of the sliding member 404, while several second guide members 502 may be coupled to an upper portion of the sliding member. While FIGS. 5 to 7 illustrate an example in which there are first guide members 500 coupled to one side only, the first guide members 500 can just as well be coupled to both sides of the sliding members 404.

The first guide members 500 and second guide members 502 may serve to guide the sliding of the sliding members 404 so that they may slide in a stable manner. The sliding members 404 are to slide only in the lengthwise (longitudinal) direction, and any movement in the upward, downward, or lateral directions are to be removed.

The first guide members 500 and second guide members 502 may remove unnecessary movement in the upward, downward, or lateral directions and allow the sliding member to slide in preset directions only.

According to a preferred embodiment of the invention, the first guide members 500 and second guide members 502 can be made from an elastic material, and can be implemented in the form of flat springs, for example.

Referring to FIGS. 5 to 7, the first guide members 500 and second guide members 502 may be structured as a flat spring having a multiple number of elastic wings 500*a*, 502*a*. The elasticity of the elastic bodies can prevent the sliding member from moving in a direction other than the sliding direction and can minimize friction during sliding.

The wings 500*a*, 502*a* may contact the main cover and a side surface of a guide groove formed in the sub-cover, and the elasticity of the wings 500*a*, 502*a* may enable a stable guided movement.

Elastic bodies of various forms, other than the structure illustrated in FIGS. 5 to 7, can be utilized as the guide members. It will be apparent to the skilled person that such variations are encompassed by the scope of the invention.

According to a preferred embodiment of the invention, a means may be provided for adjusting the depth by which a tuning element 430 is inserted inside the filter. Thus, according to an aspect of the invention, tuning may be performed by sliding as well as by adjusting the insertion depth of the tuning elements, so that a wider tuning range may be provided.

A description will now be provided as follows, with reference to FIG. 7, on a structure for adjusting the insertion depths of the tuning elements 430.

To each of the sliding members 404, several adjustment bolts 700 may be coupled in correspondence with the tuning elements 430, respectively. Threaded holes 702 may be formed in the sliding member 404 in which to insert the adjustment bolts 700.

According to a preferred embodiment of the invention, the adjustment bolts 700 may preferably be made of substantially the same material as that of the sliding members 404, being made of a metallic or a dielectric material.

When tuning elements made of a dielectric material are used, the tuning elements coupled to the lower portions of the adjustment bolts 700 can be coupled by adhesion. To provide stable adhesion between the adjustment bolts 700 made of a plastic and the tuning elements 430 made of a ceramic, the sliding members 404 and the adjustment bolts 700 can be made from an amorphous thermoplastic polyetherimide material.

The user can adjust the depth by which the tuning elements 430 are inserted inside the filter, by rotating the adjustment bolts 700 to adjust the depth by which the adjustment bolts 700 are inserted. After adjusting the insertion depth of the bolts, the adjustment bolts may be secured by nuts 704.

In the example shown in FIG. 5, two coupling holes 520, 522 may be formed in one end of the sliding member. The coupling holes 520, 522 are for coupling to a driving unit, such as a motor, etc., in cases where the sliding members 404 are intended to slide by way of the driving unit. The coupling between a sliding member and a motor will be described later with reference to a separate drawing. The driving unit and the sliding member can be coupled by way of the coupling holes 520, 522. According to an embodiment of the invention, threads can be formed in the coupling holes 520, 522, and the sliding members can be coupled by screw-coupling.

It is not necessary to form holes in the other end of the sliding member 404. The sliding member can be installed in the filter to simply hang on to a particular structure in such a way that allows free sliding. For example, a method can be used of forming a ledge at an end portion of the filter to which the sliding members can hang on.

Figure 8:
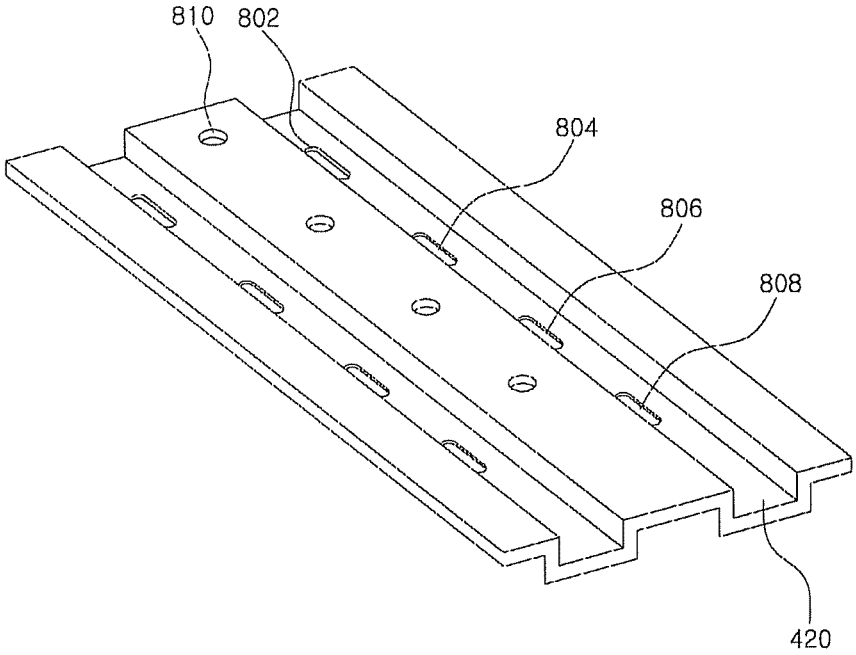
FIG. 8 illustrates the structure of a sub-cover for a tunable filter according to an embodiment of the invention.

FIG. 8 illustrates the structure of a sub-cover for a tunable filter according to an embodiment of the invention.

Referring to FIG. 8, guide grooves 420 for guiding the movement of the sliding members may be formed in the sub-cover, and several elongated holes 802, 804, 806, 808 may be formed in the guide grooves. Also, several bolt holes 810 may be formed in the sub-cover through which tuning bolts can be inserted to the inside of the filter. As described above, the tuning bolts can be used for initial tuning during the manufacture of the filter.

There may be several elongated holes 802, 804, 806, 808 formed. The elongated holes 802, 804, 806, 808 may be formed to enable the tuning elements 430 inserted inside the filter to move freely. This is because if the holes are not long, they may obstruct the sliding movement.

The positions of the several elongated holes 802, 804, 806, 808 may be set in correspondence with the positions of the tuning elements 430 penetrating from the cover. Since the intervals of the tuning elements correspond with the intervals between resonators, the intervals of the elongated holes may correspond with the intervals of the resonators and the intervals of the tuning elements 430.

The elongated holes 802, 804, 806, 808 are formed so as not to affect the sliding movement, and thus the lengths of the elongated holes 802, 804, 806, 808 can be determined by the sliding range of the sliding members 404.

Figure 9:
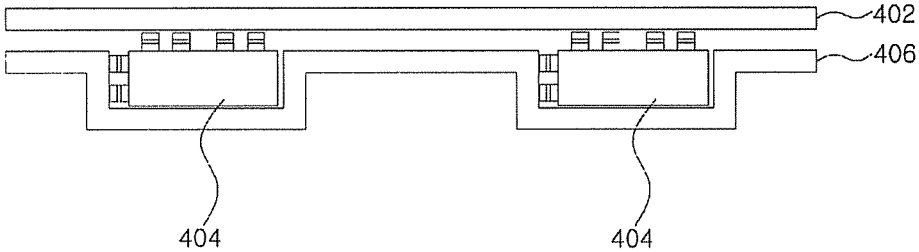
FIG. 9 is a cross-sectional view illustrating sliding members installed between an upper cover and a sub-cover according to an embodiment of the invention.
Figure 10:
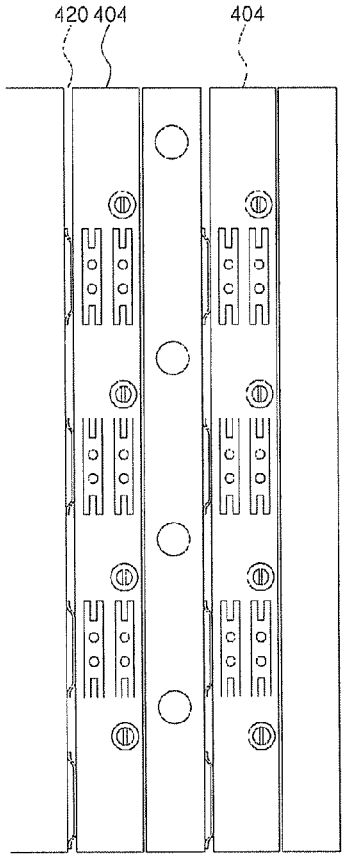
FIG. 10 is a plan view illustrating sliding members mounted in the guide grooves of a sub-cover according to an embodiment of the invention.

FIG. 9 is a cross-sectional view illustrating sliding members installed between an upper cover and a sub-cover according to an embodiment of the invention, and FIG. 10 is a plan view illustrating sliding members mounted in the guide grooves of a sub-cover according to an embodiment of the invention.

Referring to FIG. 9 and FIG. 10, the wings of the elastic first guide members 500 may have their end portions touching the side surfaces of the guide grooves 420, while the wings 502*a* of the elastic second guide members 502 may have their end portions touching the upper cover.

By having only the end portions of the wings 500*a*, 502*a* touching the side surfaces of the guide grooves and the lower portion of the main cover, the friction created during sliding can be minimized. Also, since the wings 500*a*, 502*a* are elastic, a stable contact can be maintained, preventing the sliding members from moving in a direction other than the sliding direction.

Figure 11:
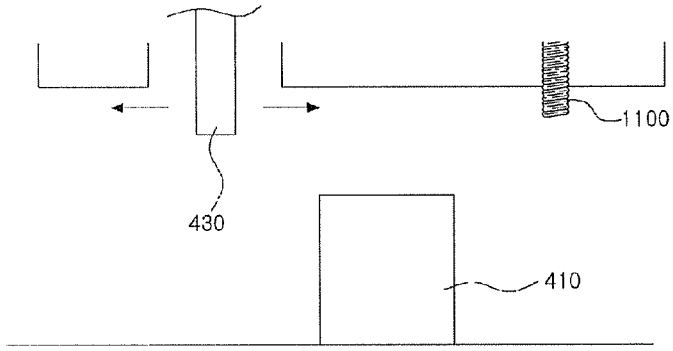
FIG. 11 is a cross-sectional view of a cavity in a tunable filter according to an embodiment of the invention.

FIG. 11 is a cross-sectional view of a cavity in a tunable filter according to an embodiment of the invention.

Referring to FIG. 11, a resonator 410 may be installed in a cavity. The resonator can be secured to a lower portion of the filter by screw-coupling and can also be formed as an integrated body with the housing of the filter. While FIG. 11 illustrates an example in which the resonator is formed as a cylinder, the resonator can take various forms, as already described above.

Above the resonator, a tuning element 430 may be positioned that is inserted from a sliding member through an elongated hole of the sub-cover. Also above the resonator, a tuning bolt 1100 may be positioned that is inserted through a bolt hole of the sub-cover.

As the sliding member 404 undergoes a sliding movement, the tuning element 430 coupled to the sliding member 404 may also slide together. The movement of the tuning element 430 causes the capacitance value to change.

Figure 12:
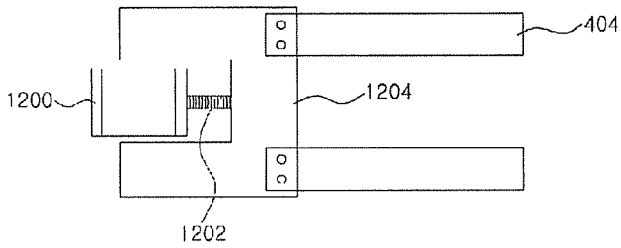
FIG. 12 and FIG. 13 illustrate the coupling between sliding members and a driving unit that slides the sliding members according to an embodiment of the invention.
Figure 13:
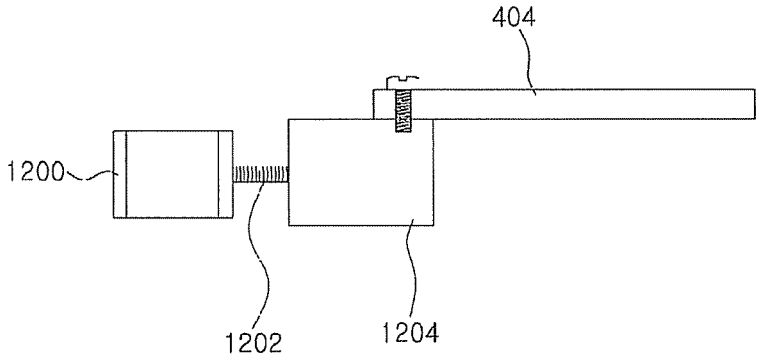

FIG. 12 and FIG. 13 illustrate the coupling between sliding members and a driving unit that slides the sliding members according to an embodiment of the invention.

Referring to FIG. 12, a driving unit may include a motor 1200, a screw 1202 coupled with the motor, and an intermediary member 1204 coupled with the screw 1202.

The motor 1200 may provide a rotational force, which may be provided to the screw 1202. The screw 1202 may convert the rotational movement of the motor 1200 into a horizontal movement. A screw hole may be formed in the intermediary member 1204 for coupling to the screw 1202, and the intermediary member 1204 may move left or right in a horizontal direction in correspondence to the rotation of the screw 1202.

In an upper portion of the intermediary member 1204, coupling holes 1206 may be formed for coupling with the sliding members 404. The coupling holes 1206 formed in the upper portion of the intermediary member may correspond with the coupling holes formed in one end of each sliding member, and two holes may be threaded, so that the intermediary member 1204 and the sliding members 404 can be coupled by screw-coupling. Of course, the coupling method is not limited to screw-coupling, and various other coupling methods can also be used.

The driving unit as described above can be built within the filter or can also be equipped externally. When equipped externally, a portion of the sliding member can protrude outward, to be coupled with the intermediary member of the driving unit.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

What is claimed is:

1. A frequency-tunable filter using a sliding system, the frequency-tunable filter comprising:

a housing having a plurality of cavities defined by partitions;

a sub-cover coupled to an upper portion of the housing and having a guide groove formed therein, wherein the guide groove has at least one side surface;

at least one sliding member installed in the guide groove and movable within the guide groove by a sliding movement;

a main cover coupled to an upper portion of the sub-cover;

a resonator provided in each of the plurality of cavities;

at least one tuning element coupled to a lower portion of the at least one sliding member to be inserted inside the housing; and at least one second guide member coupled to an upper portion of the at least one sliding member, the at least one second guide member configured to guide the at least one sliding member movement by way of contact with a lower portion of the main cover, wherein tuning is achieved by a sliding movement of the at least one sliding member, and at least one first guide member is coupled to at least one side surface of the at least one sliding member, the first guide member configured to guide the at least one sliding movement of the sliding member by way of contact with the at least one side surface of the guide groove.

2. The frequency-tunable filter of claim 1, wherein the first guide member and the at least one second guide member are elastic bodies.

3. The frequency-tunable filter of claim 2, wherein the elastic bodies each comprise a flat spring.

4. The frequency-tunable filter of claim 1, wherein an elongated hole is formed in the guide groove of the sub-cover so as to allow the at least one tuning element to be inserted in the housing and enable the at least one tuning element to freely undergo a sliding movement.

5. The frequency-tunable filter of claim 1, wherein a bolt hole for inserting a tuning bolt inside the housing is formed in the sub-cover.

6. The frequency-tunable filter of claim 1, wherein the at least one sliding member is made from an amorphous thermoplastic polyetherimide material.

7. The frequency-tunable filter of claim 6, wherein the at least one sliding member has a threaded hole formed therein, an adjustment bolt is inserted in the threaded hole, the adjustment bolt capable of having an insertion depth thereof adjusted by rotation, and the at least one tuning element is coupled to a lower portion of the adjustment bolt.

8. The frequency-tunable filter of claim 7, wherein the adjustment bolt is made from a same material as that of the at least one sliding member.

9. The frequency-tunable filter of claim 1, further comprising a driving unit configured to provide a driving power for sliding the at least one sliding member, wherein the at least one sliding member comprises a coupling hole for coupling with the driving unit.

* * * * *